US010357788B2

(12) United States Patent
Burford

(10) Patent No.: US 10,357,788 B2
(45) Date of Patent: Jul. 23, 2019

(54) CENTRIFUGAL SEPARATOR HAVING A SELF-POWERED SERVICE READINESS INDICATOR

(71) Applicant: Mann+Hummel GmbH, Ludwigsburg (DE)

(72) Inventor: Nigel Burford, Taunton (GB)

(73) Assignee: MANN+HUMMEL GmbH, Ludwigsburg (DE)

( * ) Notice: Subject to any disclaimer, the term of this patent is extended or adjusted under 35 U.S.C. 154(b) by 0 days.

(21) Appl. No.: 15/726,512

(22) Filed: Oct. 6, 2017

(65) Prior Publication Data

US 2018/0029047 A1 Feb. 1, 2018

Related U.S. Application Data

(63) Continuation of application No. PCT/CN2015/076077, filed on Apr. 8, 2015.

(51) Int. Cl.

| | |
|---|---|
| ***B04B 11/04*** | (2006.01) |
| ***B04B 13/00*** | (2006.01) |
| ***B04B 9/06*** | (2006.01) |
| ***B04B 7/06*** | (2006.01) |
| ***B04B 5/00*** | (2006.01) |

(52) U.S. Cl.

CPC ..... *B04B 11/043* (2013.01); *B04B 5/005* (2013.01); *B04B 7/06* (2013.01); *B04B 9/06* (2013.01); *B04B 13/00* (2013.01)

(58) Field of Classification Search

CPC ..... B04B 11/043; B04B 7/06; B04B 13/00; B04B 5/005; B04B 11/04; B04B 9/10; B04B 9/06

USPC ..... 494/49

See application file for complete search history.

(56) References Cited

U.S. PATENT DOCUMENTS 3,189,268 A * 6/1965 Nilsson ..... B01D 17/0214 494/10

3,762,633 A * 10/1973 Ishii ..... B04B 5/005 494/10

(Continued)

FOREIGN PATENT DOCUMENTS

DE 10103997 A1 8/2002

EP 0872282 A2 10/1998

(Continued)

*Primary Examiner* — Charles Cooley

(74) *Attorney, Agent, or Firm* — James Hasselbeck

(57) ABSTRACT

A rotor is mounted in a stationary casing of a centrifugal separator. An electrical rotation sensor with a first electric coil mounted on the rotor and a second electric coil, connectable to a power source and mounted on the casing, is provided. A processor associated with the second coil detects voltage oscillation induced in the second coil when the rotor rotates to calculate and display rotor speed. The first coil is connected in a circuit including electrodes exposed to the interior of the rotor at a predetermined position. The voltage across the second coil changes when the electrodes are contacted by accumulated material in the interior of the rotor. This change is detected to provide an indication that cleaning of the rotor is required. A permanent magnet is mounted on the rotor and causes automatic charging of the battery via the stator coil when the rotor rotates.

10 Claims, 3 Drawing Sheets

(56) References Cited

U.S. PATENT DOCUMENTS 3,986,663 A * 10/1976 Jonsson ..... B04B 1/18 494/10
4,221,323 A * 9/1980 Courtot ..... B04B 5/005 494/10
4,410,318 A * 10/1983 Bjork ..... B04B 1/10 494/10
5,735,167 A * 4/1998 Puukangas ..... G01F 23/266 73/304 C
6,074,336 A 6/2000 Purvey
6,213,928 B1 * 4/2001 Joshi ..... B04B 5/005 494/10
6,572,523 B2 * 6/2003 Herman ..... B04B 5/005 116/202
6,821,241 B2 * 11/2004 Herman ..... B04B 1/08 494/49
7,008,365 B2 * 3/2006 Hamatschek ..... B04B 11/00 494/10
7,338,426 B2 * 3/2008 Samways ..... B04B 5/005 494/10
2002/0147096 A1 * 10/2002 Herman ..... B04B 5/005 494/10
2003/0078152 A1 * 4/2003 Fischer ..... B04B 5/005 494/10
2006/0025296 A1 * 2/2006 Samways ..... B04B 5/005 494/10
2011/0281715 A1 11/2011 Burford et al.
2013/0005559 A1 1/2013 Burford et al.
2018/0029047 A1 * 2/2018 Burford ..... B04B 11/043

FOREIGN PATENT DOCUMENTS

EP 2172272 A2 4/2010
GB 1507742 A * 4/1978 ..... B04B 5/005
JP H08141442 A 6/1996
WO WO-9619292 A1 * 6/1996 ..... B04B 13/00
WO WO-2018148678 A1 * 8/2018 ..... B04B 5/005

* cited by examiner

CENTRIFUGAL SEPARATOR HAVING A SELF-POWERED SERVICE READINESS INDICATOR

CROSS-REFERENCE TO RELATED APPLICATIONS

This application is a continuation application of International Application No. PCT/CN2015/076077, having an international filing date of 8 Apr. 2015 and designating the United States, the entire contents of the aforesaid International Application being incorporated herein by reference.

BACKGROUND OF THE INVENTION

The present invention concerns a centrifugal separator.

Centrifugal separators are well known for removing contaminant particles from the lubricating oil circuit of internal combustion engines and for separating particulate matter from liquids or separating liquids of different densities in a variety of industrial processes. As contaminants accumulate within a centrifuge, it is essential that it is routinely cleaned out in order to maintain effectiveness of operation. For industrial and non-constant use engine applications, it is difficult for a user to know when it is necessary or appropriate to open the centrifuge for cleaning. A centrifuge left too long may result in a sludge compact that is too hard and difficult to remove and a heavy rotor. Conversely, a centrifuge that is opened too early in the service interval may waste valuable service time in checking and may result in use of replaceable components, e.g. paper inserts or liners, prematurely. Therefore, it would be useful to know when the centrifuge is ready to be cleaned without having to stop or open the centrifugal separator assembly.

It is desirable to provide a centrifugal separator which has some means to indicate when the centrifuge is ready to be cleaned without stopping its operation or opening the assembly for visual inspection. It is also desirable to minimise power requirements, avoid requirement for external power source and minimise requirement for replacement of parts.

European patent specification EP 0872282 A discloses a centrifuge rotor provided with an ultrasonic sensor to measure the degree of liquid filling in its interior. This is not practical in most situations.

German patent specification DE10103997 discloses an arrangement for measuring electrical capacitance in a stationary circuit associated with a rotor of centrifugal separator, change in the capacity being indicative of the loading of the rotor with separated particles.

Various rotation sensors have been proposed for centrifugal separators involving, for example, optical sensing means or other signal receiving components mounted in or outside the casing to detect a marker or transmitter on the revolving rotor.

SUMMARY OF THE INVENTION

One object of the present invention is to provide an improved, alternative means of indicating servicing readiness of the centrifugal separator. Another object of the present invention is to provide a self-powered rotation sensor for a centrifugal separator.

The present invention provides, as a first aspect, a centrifugal separator comprising a stationary casing defining an enclosure and a rotor, namely a filter housing, which is rotatably mounted in said enclosure, the rotor having a lid or cover to permit cleaning of its interior and the casing including means to permit access to the rotor; characterised in that an electrical rotation sensor is provided by a first electric circuit means mounted to the rotor and including a first coil, a second electric circuit means mounted to the casing and including a second coil connectable to a power source, and voltage sensing means associated with the second circuit to detect voltage oscillation induced in the second coil upon rotation of the rotor; and in that the first circuit means includes electrodes exposed to the interior of the rotor at a predetermined position therein, thereby to cause a detectable difference in the voltage across the second coil when said electrodes are contacted by accumulated material at said position in the interior of the rotor.

In preferred embodiments, the first electric circuit means is mounted on the lid or cover of the rotor. Thus it can be retro-fitted to an existing centrifugal separator and only the lid or cover of the rotor needs to be replaced. A removable part of the casing can also be replaced by a corresponding part to which the associated second circuit means, power source and voltage sensing means have been fitted.

If desired, the electrical rotation sensor may include a processor which is operative to calculate and display the rotation speed of the rotor. In some applications it can be desirable for a user to be aware of the operating speed of the rotor.

In a further development an external power source or requirement to replace a battery power source can be avoided by mounting a permanent magnet to the rotor whereby a battery power source mounted on the casing can be automatically charged via the second circuit means upon rotation of the rotor.

Furthermore, in some embodiments, the detection part of the system, namely the rotation sensor and the fill detector, as embodied by the voltage sensing means, may be operated only intermittently while charging via aforesaid permanent magnet arrangement takes place continuously during rotation of the centrifuge. In this way power is conserved.

In some other embodiments a separate charging coil may be used. In other words, there may be a first stator coil for purposes of rotation and fill detection and a second stator coil for purposes of charging the battery via the provision of the permanent magnet mounted on the rotor.

According to a second aspect, the invention provides a centrifugal separator comprising a stationary casing defining an enclosure and a rotor, namely a filter housing, which is rotatably mounted in said enclosure, and a rotation sensor provided as a first sensor device mounted to the rotor and a second sensor device mounted to the casing and powered by a battery power source, characterised in that the second sensor device and the battery are connected by electrical circuit means including a stator coil, and a permanent magnet is mounted to the rotor, whereby the battery is automatically charged via the stator coil upon rotation of the rotor.

Therefore, a self-powering capability, in accordance with the second aspect, may be applied in respect of any rotation sensor or any fill detector for a centrifugal separator. In other words, it need not be in combination with an electrically resistive/voltage detection means of detecting rotation and could be in combination with other sensor means, such as optical sensor means, capacitance sensor means. Also, it need not be in combination with any fill detector means. However, preferred embodiments of the present invention include all these features in combination.

BRIEF DESCRIPTION OF THE DRAWINGS

Aspects of the invention will now be described, by way of example only, with reference to the accompanying figures.

DESCRIPTION OF PREFERRED EMBODIMENTS

Figure 1:
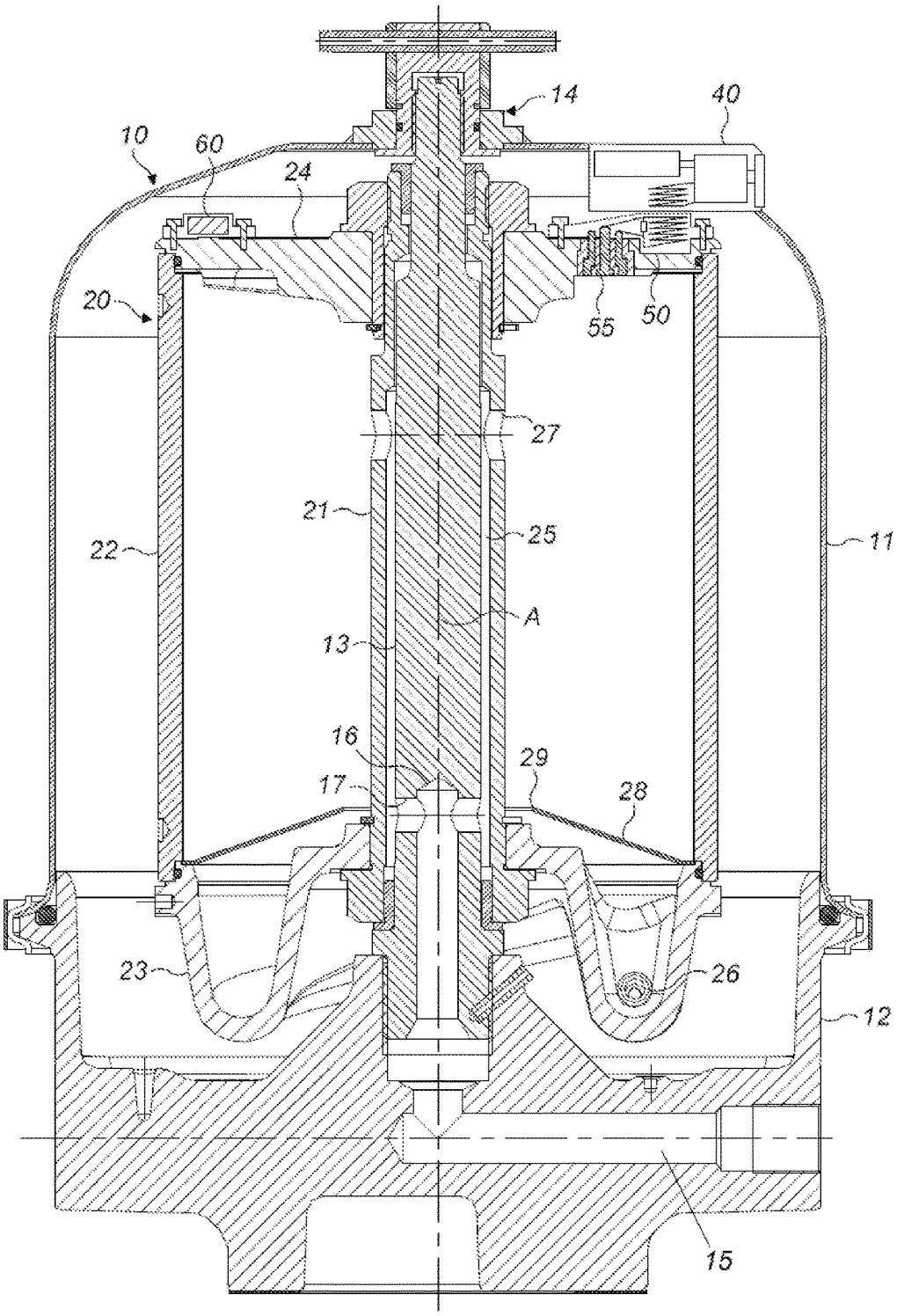
FIG. 1 is a longitudinal cross-section through a practical embodiment of centrifugal separator in accordance with the invention.

FIG. 1 illustrates a typical arrangement of a centrifugal separator to which an embodiment of the present invention, namely a non-contact self-powered electrical device that indicates rotor speed and service requirement of a centrifuge, is applied.

The separator assembly comprises a stationary casing 10 defining an enclosure and a rotor 20, namely a filter housing, which is rotatably mounted in that enclosure. The casing 10 is formed by a bell shaped cover 11 which is detachably mounted to a base 12. A spindle 13 is mounted to the base, extending upwardly therefrom to a connector assembly 14 at the top of the cover 11. The spindle 13 provides a central axis A about which the rotor 20 spins when the separator is in operation. In this exemplary embodiment, which is that of a self-powered centrifugal separator, the base 12 includes an inlet passage 15 for fluid to be cleaned, as well as an outlet, which is not visible in this figure. The spindle 13 includes an axial passage 16 in communication with the inlet passage 15 and radial openings 17 extending from that passage 16. The rotor 20 comprises an inner tube 21 and an outer cylindrical body 22 with end closures provided by a base 23 and a cover 24. The inner tube 21 is fitted onto the spindle 13 and defines a narrow annular channel 25 between the spindle openings 17 and radial openings 27 in said tube 21 at a level closer to the cover 24. The base 23 of the rotor 20 is provided with nozzles 26 which are tangentially directed relative to the spindle axis. In use, fluid is supplied at elevated pressure through the inlet passage 15 of the base 12. It flows axially through the spindle passage 16, openings 17, and annular channel 25 to exit via openings 27 into the interior of the rotor 20. Outflow of fluid from the nozzles 26 in the base 23 serves to drive the rotor and the centrifugal action caused thereby serves to deposit contaminant particles contained in the fluid on the interior surface of the cylindrical body 22.

The interior of the rotor 20 is divided by a separation cone 28 into upper and lower chambers. This cone 28 provides a frusto-conical wall which inclines downwards from a rim 29 in the vicinity of the spindle to a lower edge adjacent the internal surface of the rotor. A gap remains between the rim 29 and the inner tube 21. One purpose of this separation cone 28 is to slow the passage of fluid through the rotor so that efficiency of entrapment of contaminant particles on the internal surface of the rotor is improved. Also, by directing the fluid through the gap adjacent the inner tube 21 into the lower chamber, it prevents contaminant particles from falling directly into the area of the nozzles 26, minimising risk of any blockage. The remaining fluid drains to the base 12 of the casing 10 and exits for recirculation.

As already indicated, the precise configuration of the basic centrifugal separator assembly is not important to the present invention and many variations in detail from the foregoing would be possible in other embodiments to which aspects of the invention could be applied. It should also be understood that although the arrangement just described is of a self-powered separator where rotation of the centrifuge results from flow therethrough of fluid to be cleaned, the invention is equally applicable to centrifugal separators which have separate powered drive means for the rotor.

Figure 2:
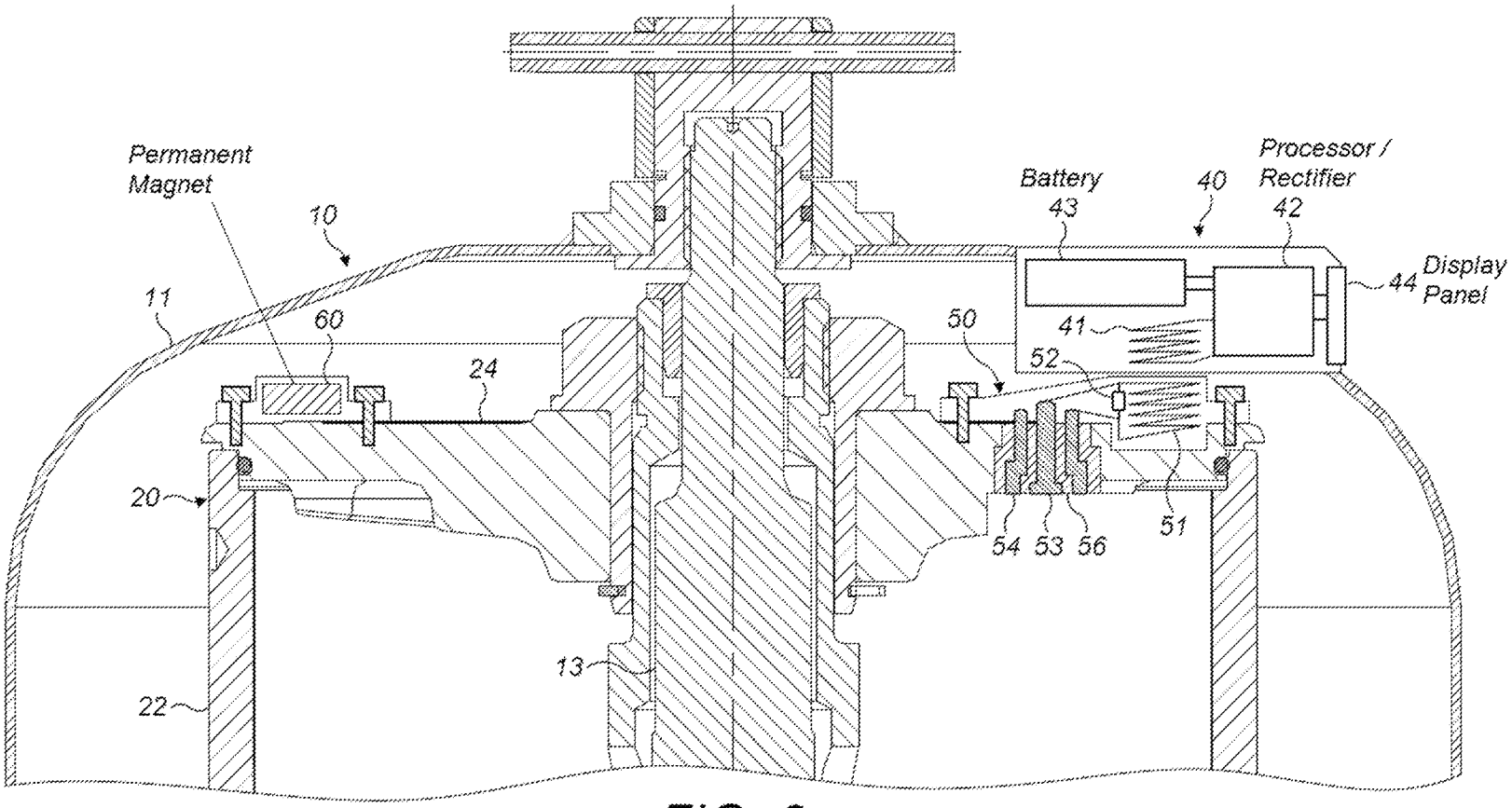
FIG. 2 is an enlarged fragmentary view, still in cross-section, of an upper region of the separator shown in FIG. 1.

In accordance with the illustrated exemplary embodiment of the invention, and as shown to larger scale in FIG. 2, a first sensor device 40 is mounted to the casing cover 11 and a second sensor device 50 is mounted to the rotor cover 24. The first sensor device 40 includes a fixed coil 41 connected to a processor 42, these being powered by a battery 43. The processor 42 includes a rectifier and other control means and is operatively connected to an externally visible display panel 44. The second sensor device 50 comprises an electrical circuit coil 51 connected in parallel with a resistor 52 to respective electrodes 53, 54. These electrodes are part of a probe, designated generally 55 in FIG. 1, which is mounted in the wall of the rotor cover 24 so that ends of the electrodes are exposed to the interior of the rotor 20. The electrodes 53, 54 are insulated from each other and from surrounding material of the rotor cover 24 by respective sleeves 56 of insulating material. In this example, the electrodes and sleeves are arranged coaxially, with one electrode 53 provided as a central metal pin or tube and the other electrode 54 provided as a surrounding cylindrical metal element. The electrodes and sleeves as shown have a stepped configuration in order to resist outward displacement during operation of the separator due to internal rotor pressure.

In operation, the processor 42 supplies a constant current from the battery 43 to the stationary coil 41 which is mounted to the centrifuge cover 11. This generates voltage and therefore a magnetic field in the stationary coil 41. The rotating coil 51, which is mounted to the rotor 20, passes near the stationary coil 41 once per every revolution of the rotor. As the rotating coil 51 passes the stationary coil 41, a current is caused to flow in the rotor coil 51 as it cuts the magnetic flux from the stationary coil 41. Due to the resistance of the electrical wire and the presence of the resistor 52, a once per revolution change in voltage will occur across the rotor coil 51 which by induction will cause a corresponding voltage change in the stationary coil 41. This is detected by the processor 42 and can be used to provide a rotor speed indication on the display panel 44.

Figure 3:
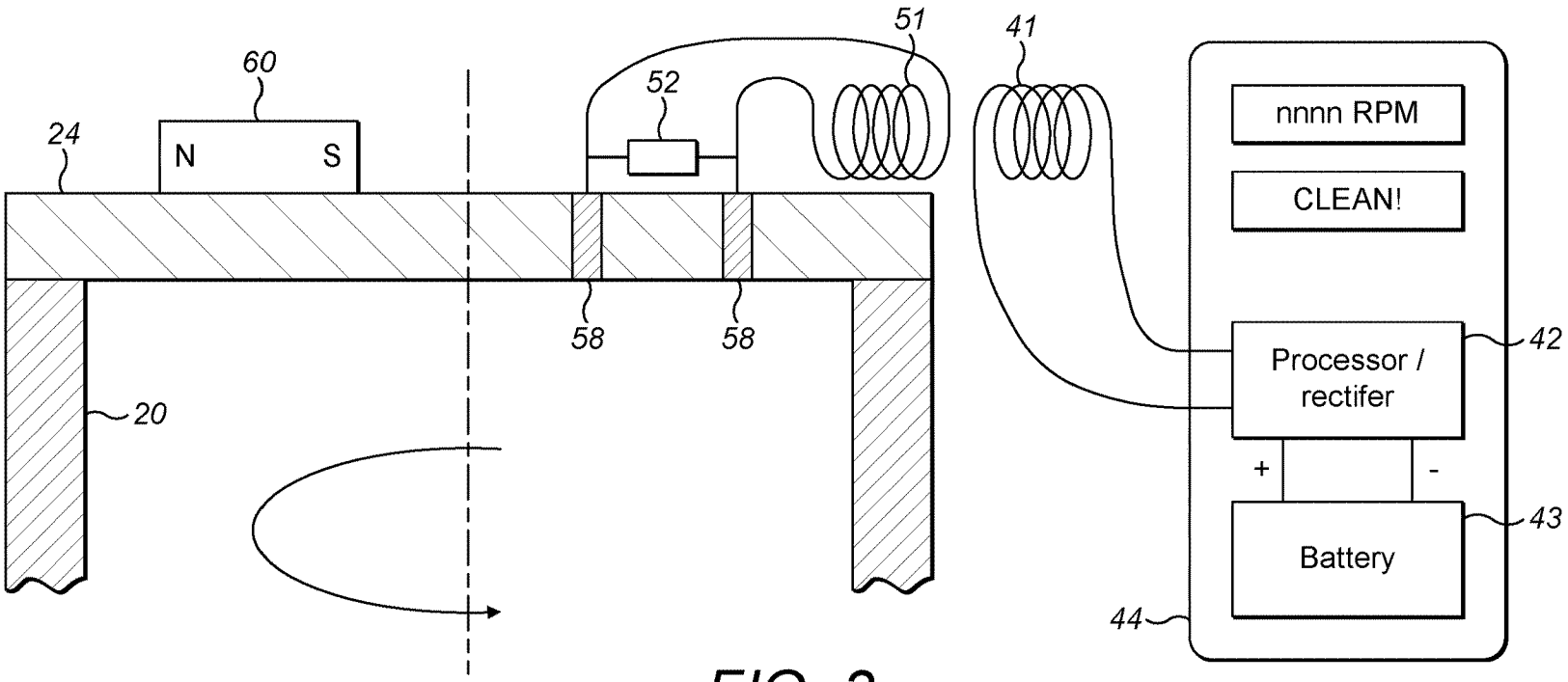
FIG. 3 is a schematic diagram of an upper region of a rotor of a centrifugal separator and an associated circuit means and detector arrangement as mounted on the casing of a centrifugal separator.

When the rotor 20 only contains oil, the resistance in the rotating coil circuit 51 is only due to the inherent resistance of the electrical wire together with that of the resistor 52. (The resistor 52 is added to provide a starting value for the resistance in the rotating coil circuit 51 as oil is considered to be insulating.) When the rotor 20 fills and contaminant material touches and covers the exposed ends of electrodes 53, 54, the total resistance value in the rotating coil circuit 51 will drop. A corresponding voltage drop will also occur in the stationary coil circuit 41. This change will be detected by the processor 42 which then provides a suitable signal for indication on the display panel 44 that the rotor is due for cleaning. FIG. 3 shows schematically how the rotation speed and the service indication may suitably be provided on the display panel 44.

The system can, therefore, detect and indicate both rotor speed and the condition when the rotor is full of contaminant.

Where the system is to be produced for retrofitting to a centrifugal separator, two resistance levels may be needed, one for engine contaminant and oil and another for more metallic, process contaminants, as arise in some industrial process applications. These can be selected depending on the application. In this respect, the relevant sensor devices can be supplied fitted to the respective rotor cover, such as 24, and the respective centrifuge cover 11 or similar, and only those parts would need to be replaced in any retrofit operation.

A permanent magnet 60 is also fixed to the rotor cover 24. It also passes the stationary coil 41 at each revolution of the rotor 20 and induces a current (a varying current) in the stationary circuit which is used, via the processor/rectifier, to charge the battery 43. As previously explained, this means of charging, thus self-powering of the rotation sensor and the fill sensor, could be employed quite separately in respect of any other electrically powered rotation sensor arrangement, or separately of any other electrically powered fill sensor arrangement, i.e. sensor arrangements different to those described herein and not necessarily based on use of resistance measurement/induced voltage from a rotor coil.

The schematic arrangement illustrated in FIG. 3 is of a variant where electrodes 58 are provided as respective pins which penetrate the rotor cover 24 at spaced locations. In other respects, the arrangement is generally the same as described above with reference to FIG. 2 and the same reference numerals are used for corresponding parts and need not be further described.

Each feature disclosed in this specification (including any accompanying claims and drawings), may be replaced by alternative features serving the same, equivalent or similar purpose, unless expressly stated otherwise. In other words, the invention is not restricted to the details of the foregoing embodiments, and variations in detail are possible in other embodiments within the scope of the appended claims.

What is claimed is:

1. A centrifugal separator comprising:

a stationary casing defining an enclosure;

a rotor rotatably mounted in the enclosure;

the rotor comprising a cover configured to permit cleaning of an interior of the rotor;

wherein the casing is configured to permit access to the rotor;

an electrical rotation sensor comprising:

a first electric circuit mounted on the rotor and including a first coil and a resistor, a second electric circuit mounted on the casing and including a second coil configured to be connected to a power source, a processor connected to the second electric circuit configured to detect voltage oscillation induced in the second coil when the rotor is rotating; and the first electric circuit includes electrodes exposed to the interior of the rotor at a predetermined position in the interior of the rotor, the electrodes positioned to detect a change in electrical resistance of fluid in the rotor, wherein as material accumulates on the electrodes, a drop in electrical resistance between the electrodes occurs due to electrical conduction through the accumulated material, the drop in resistance causing a detectable difference in a voltage across the second coil.

2. The centrifugal separator according to claim 1, wherein the first electric circuit is mounted on the cover of the rotor.

3. The centrifugal separator according to claim 1, wherein the electrical rotation sensor comprises a processor that is operative to calculate and display a rotation speed of the rotor.

4. The centrifugal separator according to claim 1, further comprising a battery connected to the second electric circuit as the power source and further comprising a permanent magnet mounted on the rotor, wherein the battery is automatically charged by the second electric circuit when the rotor is rotating.

5. The centrifugal separator according to claim 1, wherein the electrodes are coaxial probes extending through a rotor wall of the rotor and insulated from each other and from the rotor wall.

6. The centrifugal separator according to claim 5, wherein the rotor wall is the cover of the rotor.

7. The centrifugal separator according to claim 1, wherein the electrodes are a pair of pins extending through a rotor wall of the rotor and insulated from each other and from the rotor wall.

8. The centrifugal separator according to claim 7, wherein the rotor wall is the cover of the rotor.

9. The centrifugal separator according to claim 1, wherein the rotor is a filter housing.

10. A centrifugal separator comprising:

a stationary casing defining an enclosure;

a rotor rotatably mounted in the enclosure;

a rotation sensor comprising:

a first sensor device mounted on the rotor, a second sensor device mounted on the casing, a battery power source powering the second sensor device;

an electrical circuit comprising a stator coil, the electrical circuit connecting the second sensor device and the battery power source to each other;

a permanent magnet mounted on the rotor, wherein the battery power source is automatically charged via the stator coil when the rotor is rotating.

* * * * *